US005285241A

United States Patent [19]

Scheuer

[11] Patent Number: 5,285,241

[45] Date of Patent: Feb. 8, 1994

[54] MAINTAINING PRECISE ELECTROSTATIC CONTROL USING TWO ESVS

[75] Inventor: Mark A. Scheuer, Williamson, N.Y.

[73] Assignee: Xerox Corporation, Stamford, Conn.

[21] Appl. No.: 986,400

[22] Filed: Dec. 7, 1982

[51] Int. Cl.[5] ..... G03G 21/00

[52] U.S. Cl. ..... 355/208; 355/246; 355/328; 430/42

[58] Field of Search ..... 355/208, 216, 203-207, 355/214, 326, 327, 328, 246, 219; 430/54, 42

[56] References Cited

U.S. PATENT DOCUMENTS

| | | | |
|---|---|---|---|
| 4,078,929 | 3/1978 | Gundlach . | |
| 5,119,131 | 6/1992 | Paolini et al. | 355/208 |
| 5,132,730 | 7/1992 | Hurwitch et al. | 355/206 |
| 5,138,378 | 8/1992 | MacDonald et al. | 355/208 |
| 5,157,441 | 10/1992 | Scheuer et al. | 355/208 |
| 5,161,084 | 11/1992 | Morihara et al. | 355/219 X |
| 5,162,850 | 11/1992 | Nakashima | 355/214 X |
| 5,208,632 | 5/1993 | Hurwitch et al. | 355/208 |
| 5,210,572 | 5/1993 | MacDonald et al. | 355/208 |
| 5,212,029 | 5/1993 | Scheuer et al. | 355/326 X |
| 5,223,897 | 6/1993 | MacDonald et al. | 355/208 |
| 5,227,270 | 7/1993 | Scheuer et al. | 355/328 X |

*Primary Examiner*—A. T. Grimley
*Assistant Examiner*—Shuk Y. Lee

[57] ABSTRACT

Erroneous voltage readings of Electrostatic Voltmeters (ESVs), which have become contaminated by charged particles (i.e. toner) from developer housings used for developing latent images on a photoreceptor surface, are negated by adjusting the readings of the ESVs to compensate for the contamination of the ESVs. Additionally, The developer housing biases are adjusted by an amount equal to the difference between the voltages measured by the ESVs thereby insuring proper development and cleaning fields during development.

16 Claims, 4 Drawing Sheets

MAINTAINING PRECISE ELECTROSTATIC CONTROL USING TWO ESVS

CROSS-REFERENCES TO RELATED APPLICATIONS

U.S. Pat. No. 5,157,441 filed on Sep. 5, 1991 in the name of Scheuer et al and assigned to the same assignee as the instant application relates to a single pass tri-level imaging apparatus and method. Compensation for the effects of dark decay on the background voltage, $V_{Mod}$, and the color toner patch, $V_{tc}$ readings is provided using two ESVs ($ESV_1$ and $ESV_2$), the former located prior to the color or DAD housing and the latter after it. Since the CAD and black toner patch voltages are measured (using $ESV_2$) after dark decay and CAD voltage loss have occurred, no compensation for these readings is required. The DAD image voltage suffers little dark decay change over the life of the photoreceptor so the average dark decay can be built into the voltage target.

U.S. Pat. No. 5,212,029 filed on Sep. 5, 1991 in the name of Scheuer et al and assigned to the same assignee as the instant application relates to toner patch generation for use in tri-level imaging which is effected using a laser ROS. Two toner patches are formed using a single toner patch generator of the type commonly used in the prior art. The patch generator, used by itself serves to form one toner patch latent image and together with the ROS exposure device of the imaging apparatus is used to form the other toner patch latent image.

U.S. patent application Ser. No. 07/755,473 filed on Sep. 5, 1991 in the name of Scheuer et al and assigned to the same assignee as the instant application relates to a pair of Electrostatic Voltmeters (ESV) which are utilized to control the photoreceptor charging voltage in a Tri-Level imaging apparatus. One of the ESVs is used to control the voltage increases of a charging device. The other ESV is used to monitor the charge level of the charged area image of a Tri-Level image. When a critical value is sensed the control of the charging device is shifted to the ESV that monitors the charged area image level and limits the output from the charging device to a predetermined target value.

U.S. Pat. No. 5,227,270 filed on Sep. 5, 1991 in the name of Scheuer et al and assigned to the same assignee as the instant application relates to a single pass tri-level imaging apparatus, wherein a pair of Electrostatic Voltmeters (ESV) are utilized to monitor various control patch voltages to allow for feedback control of Infra-Red Densitometer (IRD) readings.

The ESV readings are used to adjust the IRD readings of each toner patch. For the black toner patch, readings of an ESV positioned between two developer housing structures are used to monitor the patch voltage. If the voltage is above target (high development field) the IRD reading is increased by an amount proportional to the voltage error. For the color toner patch, readings using an ESV positioned upstream of the developer housing structures and the dark decay projection to the color housing are used to make a similar correction to the color toner patch IRD readings (but opposite in sign because, for color, a lower voltage results in a higher development field).

U.S. Pat. No. 5,210,572 filed on Sep. 5, 1991 in the name of MacDonald et al and assigned to the same assignee as the instant application relates to toner dispensing rate adjustment wherein the Infra-Red Densitometer (IRD) readings of developed toner patches in a tri-level imaging apparatus are compared to target values stored in Nonvolatile Memory (NVM) and are also compared to the previous IRD reading. Toner dispensing decisions (i.e. addition or reduction) are based on both comparisons. In this manner, not only are IRD readings examined as to how far the reading is from the target, they are examined as to current trend (i.e. whether the reading is moving away from or toward the target).

U.S. Pat. No. 5,223,897 filed on Sep. 5, 1991 in the name of MacDonald et al and assigned to the same assignee as the instant application relates to a tri-level imaging apparatus wherein two sets of targets, one for use during cycle up convergence of electrostatics and one during runtime enable single pass cleaning of developed patches, during cycle up convergence. To this end, different targets from those used during runtime are used for the preclean, transfer and pretransfer dicorotrons during cycle up.

Proper charging of the photoreceptor during runtime and cycle up convergence is also enabled by the provision of two charging targets, one for each mode of operation.

U.S. Pat. No. 5,208,632 filed on Sep. 5, 1991 in the name of Hurwitch et al and assigned to the same assignee as the instant application relates to cycle up convergence of electrostatics in a tri-level imaging apparatus wherein cycle up convergence is shortened through the use of an image output terminal (IOT) resident image (on a pixel or control board) to obtain charge, discharge and background voltage readings on every pitch.

U.S. Pat. No. 5,138,378 granted to MacDonald et al on Aug. 11, 1992 relates to recalculation of electrostatic target values in a tri-level imaging apparatus to extend the useful life of the photoreceptor. The increase in residual voltage due to Photoreceptor aging which would normally necessitate photoreceptor disposal is obviated by resetting the target voltage for the full ROS exposure when it reaches its exposure limit with current photoreceptor conditions. All contrast voltage targets are then recalculated based on this new target.

The new targets are calculated based on current capability of the overall system and the latitude is based on voltage instead of exposure.

U.S. Pat. No. 5,236,795 filed on Sep. 5, 1991 in the name of Berman et al and assigned to the same assignee as the instant application relates to the use of Infra-Red Densitometer (IRD) readings to check the efficiency of two-pass cleaning of the black toner patch in a tri-level imaging apparatus. The IRD examines the background patch of the tri-level image and declares a machine fault if excessive toner is detected.

U.S. Pat. No. 5,132,730 granted to Hurwitch et al on Jul. 21, 1992 relates to a single pass, tri-level imaging apparatus, machine cycle down which is initiated when the color developer housing is functioning improperly. The voltage level of the color image prior to its development is read using an electrostatic voltmeter (ESV). The voltage level thereof is also read after development. The difference between these two readings is compared to an arbitrary target value and a machine cycle down is initiated if the difference is greater than the target.

U.S. Pat. No. 5,119,131 granted to Paolini et al on Jun. 2, 1992 relates to a single pass, tri-level imaging apparatus, wherein erroneous voltage readings of an Electrostatic Voltmeter (ESV) which has become contaminated by charged particles (i.e. toner) are negated by using two ESVs.

During each cycle up following a normal cycle down, a pair of Electrostatic Voltmeters (ESVs) are utilized to measure the voltage level on a portion of relatively uncharged portion of a photoreceptor. Using one of the ESVs, which is less prone to contamination, as a reference, the zero offset of the other is adjusted to achieve the same residual photoreceptor voltage reading. The difference in the readings which is due to toner contamination is the zero offset between the two ESVs. The offset is used to adjust all subsequent voltage readings of the ESV until a new offset is measured.

While the '131 patent addresses the problem of erroneous voltage readings of electrostatic voltmeters used in a xerographic imaging process, the solution disclosed therein assumes a toner-free reference ESV. Ignoring the contamination of the reference ESV results in improper development and cleaning fields during development.

Accordingly, it is the primary object of the present invention to provide a tri-level imaging system which does not ignore the adverse affects of contamination of a reference ESV that has become contaminated with toner.

It is another object of the present invention to adjust the developer housing biases to reflect particle contamination of ESVs.

It is yet another object of the present invention to adjust the developer biases by an amount equal to the difference between a reference voltage applied to the ground plane of a photoreceptor and the reading of a reference ESV.

BACKGROUND OF THE INVENTION

This invention relates generally to highlight color imaging and more particularly to the formation of tri-level highlight color images in a single pass.

The invention can be utilized in the art of xerography or in the printing arts. In the practice of conventional xerography, it is the general procedure to form electrostatic latent images on a xerographic surface by first uniformly charging a photoreceptor. The photoreceptor comprises a charge retentive surface. The charge is selectively dissipated in accordance with a pattern of activating radiation corresponding to original images. The selective dissipation of the charge leaves a latent charge pattern on the imaging surface corresponding to the areas not exposed by radiation.

This charge pattern is made visible by developing it with toner. The toner is generally a colored powder which adheres to the charge pattern by electrostatic attraction.

The developed image is then fixed to the imaging surface or is transferred to a receiving substrate such as plain paper to which it is fixed by suitable fusing techniques.

The concept of tri-level, highlight color xerography is described in U.S. Pat. No. 4,078,929 issued in the name of Gundlach. The patent to Gundlach teaches the use of tri-level xerography as a means to achieve single-pass highlight color imaging. As disclosed therein the charge pattern is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development systems are biased to about the background voltage. Such biasing results in a developed image of improved color sharpness.

In highlight color xerography as taught by Gundlach, the xerographic contrast on the charge retentive surface or photoreceptor is divided into three levels, rather than two levels as is the case in conventional xerography. The photoreceptor is charged, typically to 900+volts. It is exposed imagewise, such that one image corresponding to charged image areas (which are subsequently developed by charged-area development, i.e. CAD) stays at the full photoreceptor potential ($V_{CAD}$ or $V_{ddp}$). $V_{ddp}$ is the voltage on the photoreceptor due to the loss of voltage while the photoreceptor remains charged in the absence of light, otherwise known as dark decay. The other image is exposed to discharge the photoreceptor to its residual potential, i.e. $V_{DAD}$ or Vc (typically −100 volts) which corresponds to discharged area images that are subsequently developed by discharged-area development (DAD) and the background area is exposed such as to reduce the photoreceptor potential to halfway between the $V_{CAD}$ and $V_{DAD}$ potentials, (typically −500 volts) and is referred to as $V_{white}$ or $V_w$. The CAD developer is typically biased about 100 volts closer to $V_{CAD}$ than $V_{white}$ (about −600 volts), and the DAD developer system is biased about −100 volts closer to $V_{DAD}$ than $V_{white}$ (about 400 volts). As will be appreciated, the highlight color need not be a different color but may have other distinguishing characteristics. For, example, one toner may be magnetic and the other non-magnetic.

BRIEF SUMMARY OF THE INVENTION

Erroneous voltage readings of Electrostatic Voltmeter (ESVs), which have become contaminated by charged particles (i.e. toner) from developer housings used for developing latent images on a photoreceptor surface, are negated by adjusting the readings of the ESVs to compensate for the contamination of the ESVs. Additionally, the developer housing biases are adjusted to insure proper development and cleaning fields during development.

During each cycle up following a normal cycle down, the DC bias from one of the developer housings is routed to the ground plane of the photoreceptor for a brief period of time. Both ESVs read the voltage on the photoreceptor which is equal to the combination of the developer housing bias on the ground plane plus the residual voltage on the photoreceptor. One of the pair of Electrostatic Voltmeters (ESVs), therefore, $ESV_1$ is utilized to measure the voltage level on a portion of the photoreceptor. This ESV is used as a reference and the zero offset of the other ESV ($ESV_2$) is adjusted to obtain the same reading. Additionally, the DC voltage supply outputs for both the color and black developer housings are adjusted by the difference between bias voltage output that was placed on the photoreceptor ground plane and the actual reading of the reference ESV.

As a result of the foregoing adjustments to $ESV_2$ and the developer housing biases, the combined voltage reading due to residual voltage on the photoreceptor and any combination of charged particles within the probe housing of the reference ESV ($ESV_1$) is arbitrarily set to zero. All other voltages are now established relative to the reference ESV. Therefore, all of the systems electrostatic values are properly set with respect to each other thereby maintaining proper development and cleaning fields over the life of the machine.

DETAILED DESCRIPTION OF THE PREFERRED EMBODIMENT OF THE INVENTION

Figure 1A:
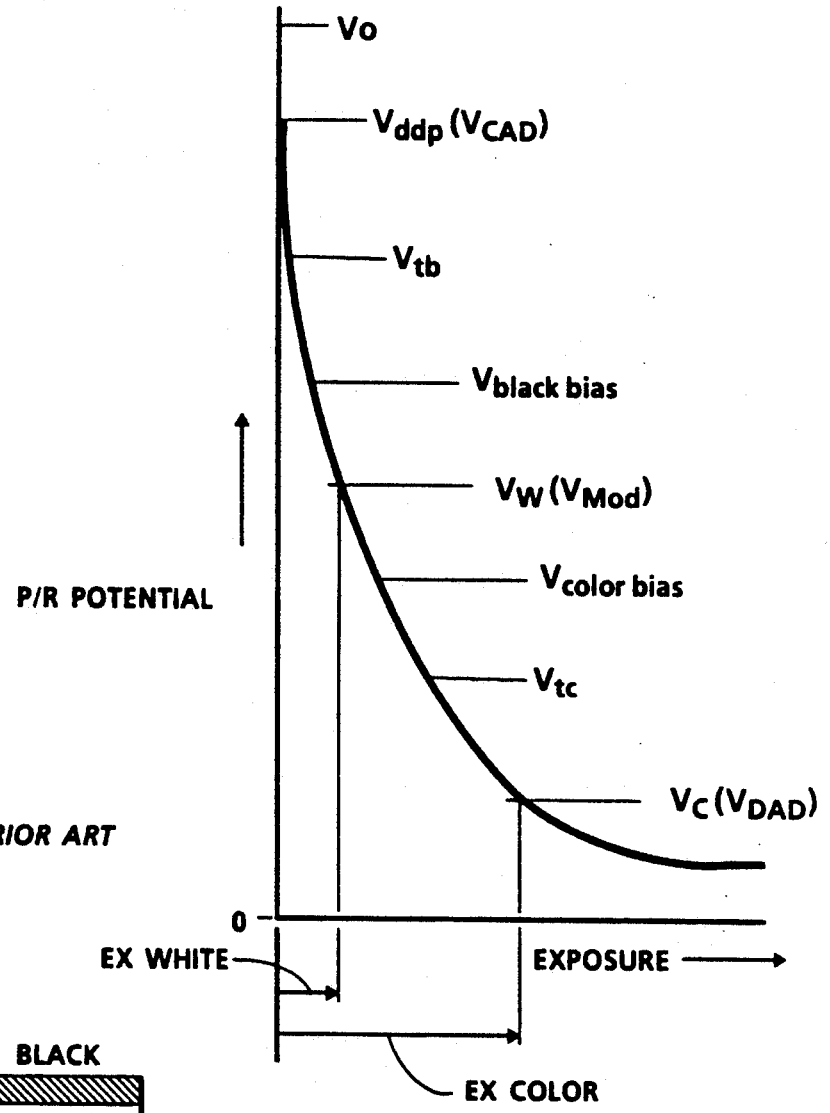
PRIOR ART FIG. 1a
FIG. 1*a* is a plot of photoreceptor potential versus exposure illustrating a tri-level electrostatic latent image.
Figure 1B:
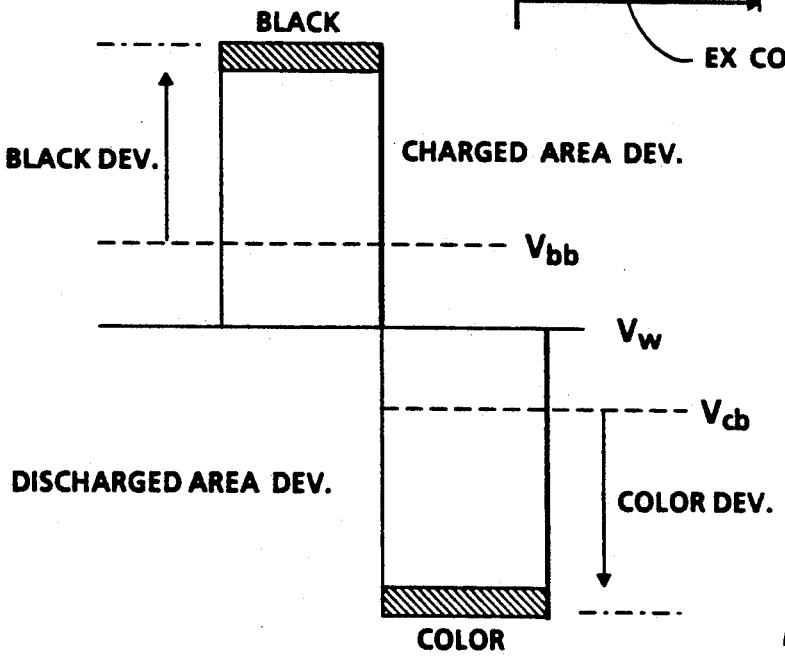
PRIOR ART FIG. 1b
FIG. 1*b* is a plot of photoreceptor potential illustrating single-pass, highlight color latent image characteristics.

For a better understanding of the concept of tri-level, highlight color imaging, a description thereof will now be made with reference to FIGS. 1*a* and 1*b*. FIG. 1*a* shows a PhotoInduced Discharge Curve (PIDC) for a tri-level electrostatic latent image according to the present invention. Here $V_0$ is the initial charge level, $V_{ddp}$ ($V_{CAD}$) the dark discharge potential (unexposed), $V_w$ ($V_{Mod}$) the white or background discharge level and $V_c$ ($V_{DAD}$) the photoreceptor residual potential (full exposure using a three level Raster Output Scanner, ROS). Nominal voltage values for $V_{CAD}$, $V_{Mod}$ and $V_{DAD}$ are, for example, 788, 423 and 123, respectively.

Color discrimination in the development of the electrostatic latent image is achieved when passing the photoreceptor through two developer housings in tandem or in a single pass by electrically biasing the housings to voltages which are offset from the background voltage $V_{Mod}$, the direction of offset depending on the polarity or sign of toner in the housing. One housing (for the sake of illustration, the second) contains developer with black toner having triboelectric properties (positively charged) such that the toner is driven to the most highly charged ($V_{ddp}$) areas of the latent image by the electrostatic field between the photoreceptor and the development rolls biased at $V_{black\ bias}$ ($V_{bb}$) as shown in FIG. 1*b*. Conversely, the triboelectric charge (negative charge) on the colored toner in the first housing is chosen so that the toner is urged towards parts of the latent image at residual potential, $V_{DAD}$ by the electrostatic field existing between the photoreceptor and the development rolls in the first housing which are biased to $V_{color\ bias}$, ($V_{cb}$). Nominal voltage levels for $V_{bb}$ and $V_{cb}$ are 641 and 294, respectively.

Figure 2:
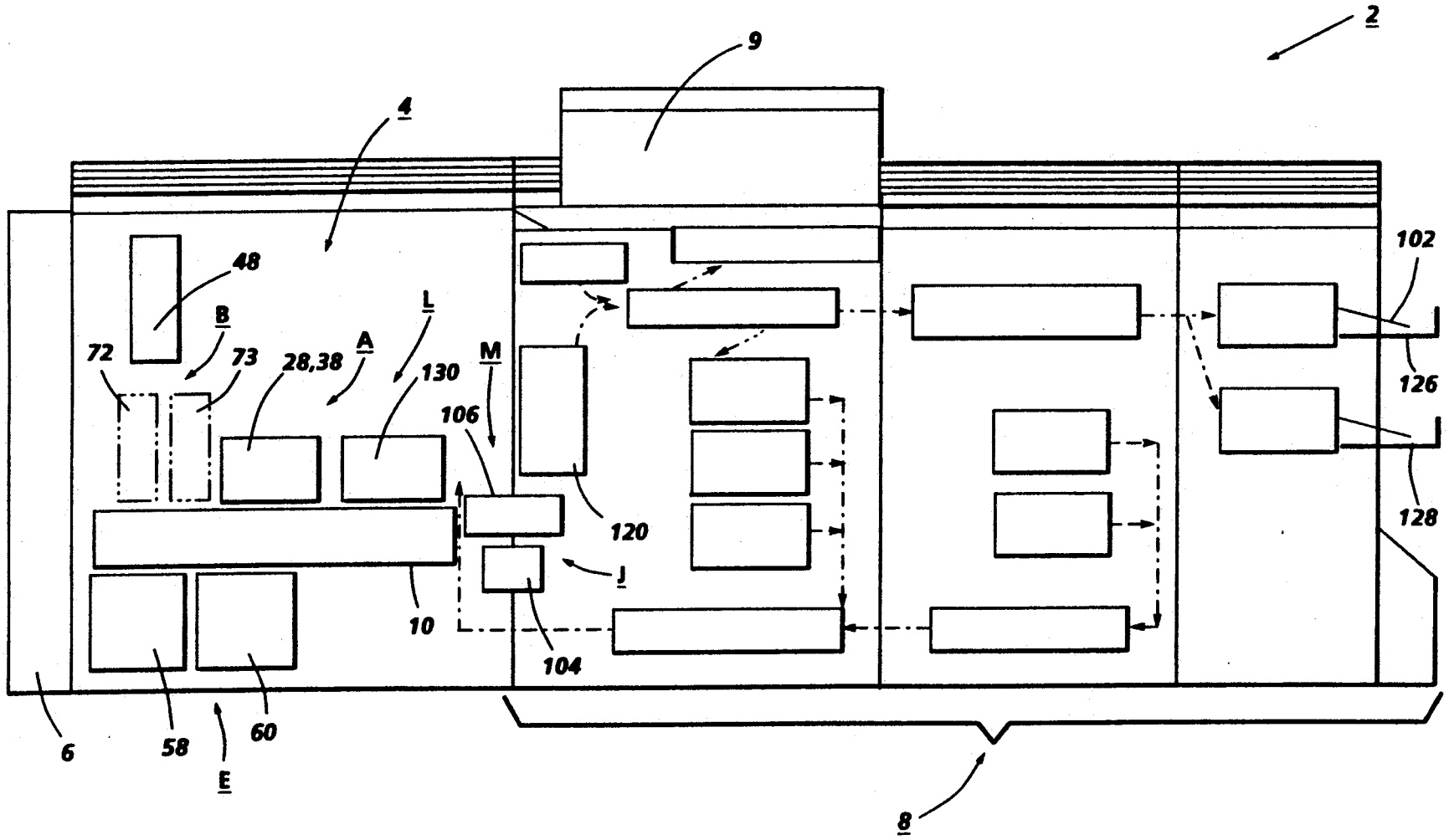
FIG. 2 is schematic illustration of a printing apparatus incorporating the inventive features of the invention.
Figure 3:
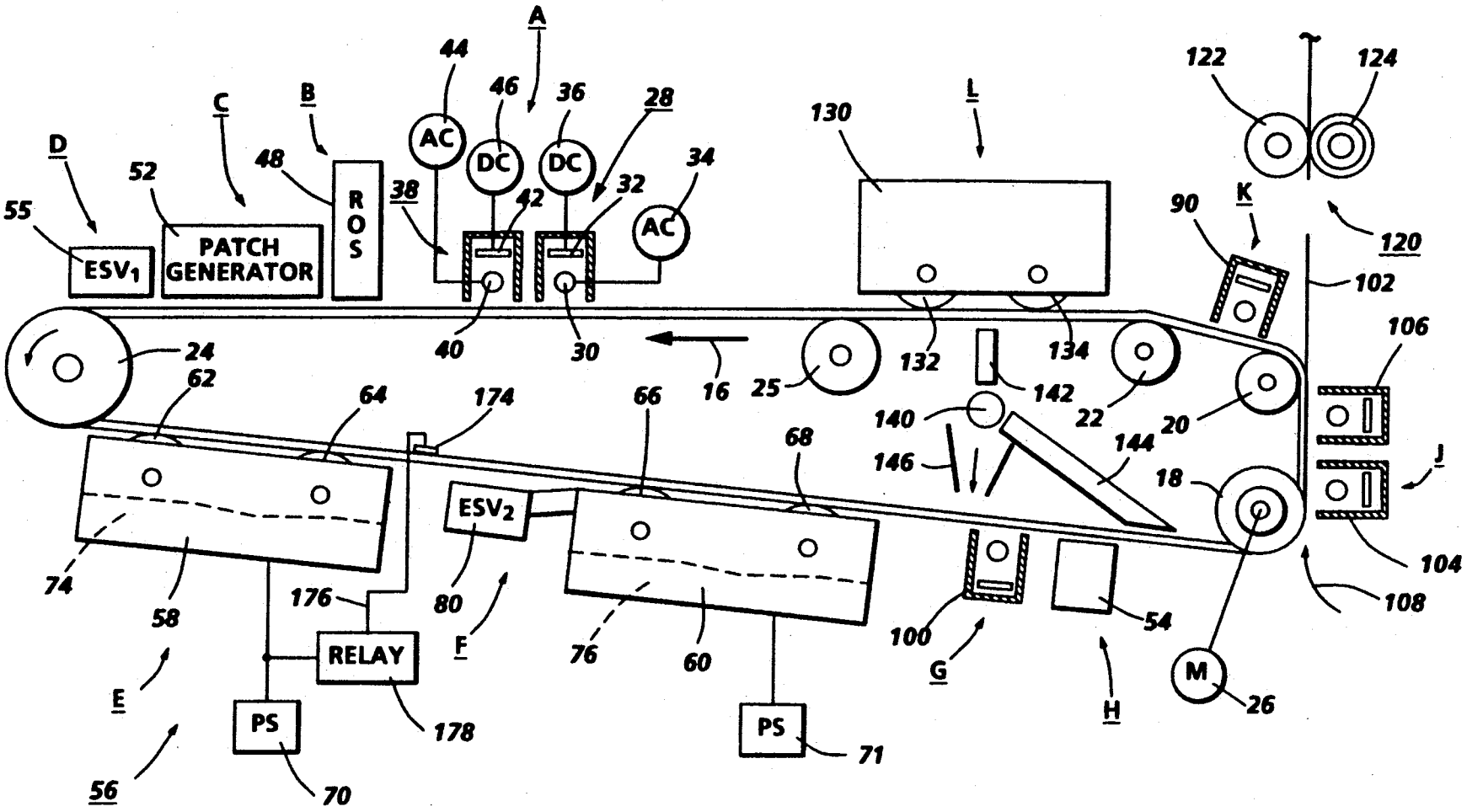
FIG. 3 a schematic of the xerographic process stations including the active members for image formation as well as the control members operatively associated therewith of the printing apparatus illustrated in FIG. 2.

As shown in FIGS. 2 and 3, a highlight color printing apparatus 2 in which the invention may be utilized comprises a xerographic processor module 4, an electronics module 6, a paper handling module 8 and a user interface (IC) 9. A charge retentive member in the form of an Active Matrix (AMAT) photoreceptor belt 10 including a ground plane is mounted for movement in an endless path past a charging station A, an exposure station B, a test patch generator station C, a first Electrostatic Voltmeter (ESV) station D, a developer station E, a second ESV station F within the developer station E, a pretransfer station G, a toner patch reading station H where developed toner patches are sensed, a transfer station J, a preclean station K, cleaning station L and a fusing station M. Belt 10 moves in the direction of arrow 16 to advance successive portions thereof sequentially through the various processing stations disposed about the path of movement thereof. Belt 10 is entrained about a plurality of rollers 18, 20, 22, 23 and 24, the former of which can be used as a drive roller and the latter of which can be used to provide suitable tensioning of the photoreceptor belt 10. Motor 26 rotates roller 18 to advance belt 10 in the direction of arrow 16. Roller 18 is coupled to motor 26 by suitable means such as a belt drive, not shown. The photoreceptor belt may comprise a flexible belt photoreceptor. Typical belt photoreceptors are disclosed in U.S. Pat. No. 4,588,667, U.S. Pat. No. 4,654,284 and U.S. Pat. No. 4,780,385.

As can be seen by further reference to FIGS. 2 and 3, initially successive portions of belt 10 pass through charging station A. At charging station A, a primary corona discharge device in the form of dicorotron indicated generally by the reference numeral 28, charges the belt 10 to a selectively high uniform negative potential, $V_0$. As noted above, the initial charge decays to a dark decay discharge voltage, $V_{ddp}$, ($V_{CAD}$). The dicorotron is a corona discharge device including a corona discharge electrode 30 and a conductive shield 32 located adjacent the electrode. The electrode is coated with relatively thick dielectric material. An AC voltage is applied to the dielectrically coated electrode via power source 34 and a DC voltage is applied to the shield 32 via a DC power supply 36. The delivery of charge to the photoconductive surface is accomplished by means of a displacement current or capacitative coupling through the dielectric material. The flow of charge to the photoreceptor 10 is regulated by means of the DC bias applied to the dicorotron shield. In other words, the photoreceptor will be charged to the voltage applied to the shield 32. For further details of the dicorotron construction and operation, reference may be had to U.S. Pat. No. 4,086,650 granted to Davis et al on Apr. 25, 1978.

A feedback dicorotron 38 comprising a dielectrically coated electrode 40 and a conductive shield 42 operatively interacts with the dicorotron 28 to form an integrated charging device (ICD). An AC power supply 44 is operatively connected to the electrode 40 and a DC power supply 46 is operatively connected to the conductive shield 42.

Next, the charged portions of the photoreceptor surface are advanced through exposure station B. At exposure station B, the uniformly charged photoreceptor or charge retentive surface 10 is exposed to a laser based input and/or output scanning device 48 which causes the charge retentive surface to be discharged in accordance with the output from the scanning device. Preferably the scanning device is a three level laser Raster Output Scanner (ROS). Alternatively, the ROS could be replaced by a conventional xerographic exposure device. The ROS comprises optics, sensors, laser tube and resident control or pixel board.

The photoreceptor, which is initially charged to a voltage $V_0$, undergoes dark decay to a level $V_{ddp}$ or $V_{CAD}$ equal to about −900 volts to form CAD images. When exposed at the exposure station B it is discharged to $V_c$ or $V_{DAD}$ equal to about −100 volts to form a DAD image which is near zero or ground potential in the highlight color (i.e. color other than black) parts of the image. See FIG. 1*a*. The photoreceptor is also discharged to $V_w$ or $V_{mod}$ equal to approximately minus 500 volts in the background (white) areas.

A patch generator 52 (FIGS. 3 and 4) in the form of a conventional exposure device utilized for such purpose is positioned at the patch generation station C. It serves to create toner test patches in the interdocument zone which are used both in a developed and undeveloped condition for controlling various process functions. An Infra-Red densitometer (IRD) 54 is utilized to sense or measure the reflectance of test patches after they have been developed.

After patch generation, the photoreceptor is moved through a first ESV station D where an ESV ($ESV_1$) 55 is positioned for sensing or reading certain electrostatic charge levels (i.e. $V_{DAD}$, $V_{CAD}$, $V_{Mod}$, and $V_{tc}$) on the photoreceptor prior to movement of these areas of the photoreceptor moving through the development station E.

At development station E, a magnetic brush development system, indicated generally by the reference numeral 56 advances developer materials into contact with the electrostatic latent images on the photoreceptor. The development system 56 comprises first and second developer housing structures 58 and 60. Preferably, each magnetic brush development housing includes a pair of magnetic brush developer rollers. Thus, the housing 58 contains a pair of rollers 62, 64 while the housing 60 contains a pair of magnetic brush rollers 66, 68. Each pair of rollers advances its respective developer material into contact with the latent image. Appropriate developer biasing is accomplished via power supplies 70 and 71 electrically connected to respective developer housings 58 and 60. A pair of toner replenishment devices 72 and 73 (FIG. 2) are provided for replacing the toner as it is depleted from the developer housing structures 58 and 60.

Color discrimination in the development of the electrostatic latent image is achieved by passing the photoreceptor past the two developer housings 58 and 60 in a single pass with the magnetic brush rolls 62, 64, 66 and 68 electrically biased to voltages which are offset from the background voltage $V_{Mod}$, the direction of offset depending on the polarity of toner in the housing. One housing e.g. 58 (for the sake of illustration, the first) contains red conductive magnetic brush (CMB) developer 74 having triboelectric properties (i.e. negative charge) such that it is driven to the least highly charged areas at the potential $V_{DAD}$ of the latent images by the electrostatic development field ($V_{DAD}-V_{color\ bias}$) between the photoreceptor and the development rolls 62, 64. These rolls are biased using a chopped DC bias via power supply 70.

The triboelectric charge on conductive black magnetic brush developer 76 in the second housing is chosen so that the black toner is urged towards the parts of the latent images at the most highly charged potential $V_{CAD}$ by the electrostatic development field ($V_{CAD}-V_{black\ bias}$) existing between the photoreceptor and the development rolls 66, 68. These rolls, like the rolls 62, 64, are also biased using a chopped DC bias via power supply 72. By chopped DC (CDC) bias is meant that the housing bias applied to the developer housing is alternated between two potentials, one that represents roughly the normal bias for the DAD developer, and the other that represents a bias that is considerably more negative than the normal bias, the former being identified as $V_{Bias\ Low}$ and the latter as $V_{Bias\ High}$. This alternation of the bias takes place in a periodic fashion at a given frequency, with the period of each cycle divided up between the two bias levels at a duty cycle of from 5–10% (Percent of cycle at $V_{Bias\ High}$) and 90–95% at $V_{Bias\ Low}$. In the case of the CAD image, the amplitude of both $V_{Bias\ Low}$ and $V_{Bias\ High}$ are about the same as for the DAD housing case, but the waveform is inverted in the sense that the bias on the CAD housing is at $V_{Bias\ High}$ for a duty cycle of 90–95%. Developer bias switching between $V_{Bias\ High}$ and $V_{Bias\ Low}$ is effected automatically via the power supplies 70 and 74. For further details regarding CDC biasing, reference may be had to U.S. Pat. No. 5,080,988 granted to Germain et al on Jan. 14, 1992.

In contrast, in conventional tri-level imaging as noted above, the CAD and DAD developer housing biases are set at a single value which is offset from the background voltage by approximately −100 volts. During image development, a single developer bias voltage is continuously applied to each of the developer structures. Expressed differently, the bias for each developer structure has a duty cycle of 100%.

Because the composite image developed on the photoreceptor consists of both positive and negative toner, a negative pretransfer dicorotron member 100 at the pretransfer station G is provided to condition the toner for effective transfer to a substrate using positive corona discharge.

Subsequent to image development a sheet of support material 102 (FIG. 3) is moved into contact with the toner image at transfer station J. The sheet of support material is advanced to transfer station J by conventional sheet feeding apparatus comprising a part of the paper handling module 8. Preferably, the sheet feeding apparatus includes a feed roll contacting the uppermost sheet of a stack copy sheets. The feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station J.

Transfer station J includes a transfer dicorotron 104 which sprays positive ions onto the backside of sheet 102. This attracts the negatively charged toner powder images from the belt 10 to sheet 102. A detack dicorotron 106 is also provided for facilitating stripping of the sheets from the belt 10.

After transfer, the sheet continues to move, in the direction of arrow 108, onto a conveyor (not shown) which advances the sheet to fusing station M. Fusing station M includes a fuser assembly, indicated generally by the reference numeral 120, which permanently affixes the transferred powder image to sheet 102. Preferably, fuser assembly 120 comprises a heated fuser roller 122 and a backup roller 124. Sheet 102 passes between fuser roller 122 and backup roller 124 with the toner powder image contacting fuser roller 122. In this manner, the toner powder image is permanently affixed to sheet 102 after it is allowed to cool. After fusing, a chute, not shown, guides the advancing sheets 102 to a catch trays 126 and 128 (FIG. 2), for subsequent removal from the printing machine by the operator.

After the sheet of support material is separated from photoconductive surface of belt 10, the residual toner particles carried by the non-image areas on the photoconductive surface are removed therefrom. These particles are removed at cleaning station L. A cleaning housing 100 supports therewithin two cleaning brushes 132, 134 supported for counter-rotation with respect to the other and each supported in cleaning relationship with photoreceptor belt 10. Each brush 132, 134 is generally cylindrical in shape, with a long axis arranged generally parallel to photoreceptor belt 10, and transverse to photoreceptor movement direction 16. Brushes 132, 134 each have a large number of insulative fibers mounted on base, each base respectively journaled for rotation (driving elements not shown). The brushes are typically detoned using a flicker bar and the toner so removed is transported with air moved by a vacuum source (not shown) through the gap between the housing and photoreceptor belt 10, through the insulative fibers and exhausted through a channel, not shown. A typical brush rotation speed is 1300 rpm, and the brush/-photoreceptor interference is usually about 2 mm. Brushes 132, 134 beat against flicker bars (not shown) for the release of toner carried by the brushes and for effecting suitable tribo charging of the brush fibers.

Subsequent to cleaning, a discharge lamp 140 floods the photoconductive surface 10 with light to dissipate any residual negative electrostatic charges remaining prior to the charging thereof for the successive imaging cycles. to this end, a light pipe 142 is provided. Another light pipe 144 serves to illuminate the backside of the photoreceptor downstream of the pretransfer dicorotron 100. The photoreceptor is also subjected to flood illumination from the lamp 140 via a light channel 146.

Figure 4:
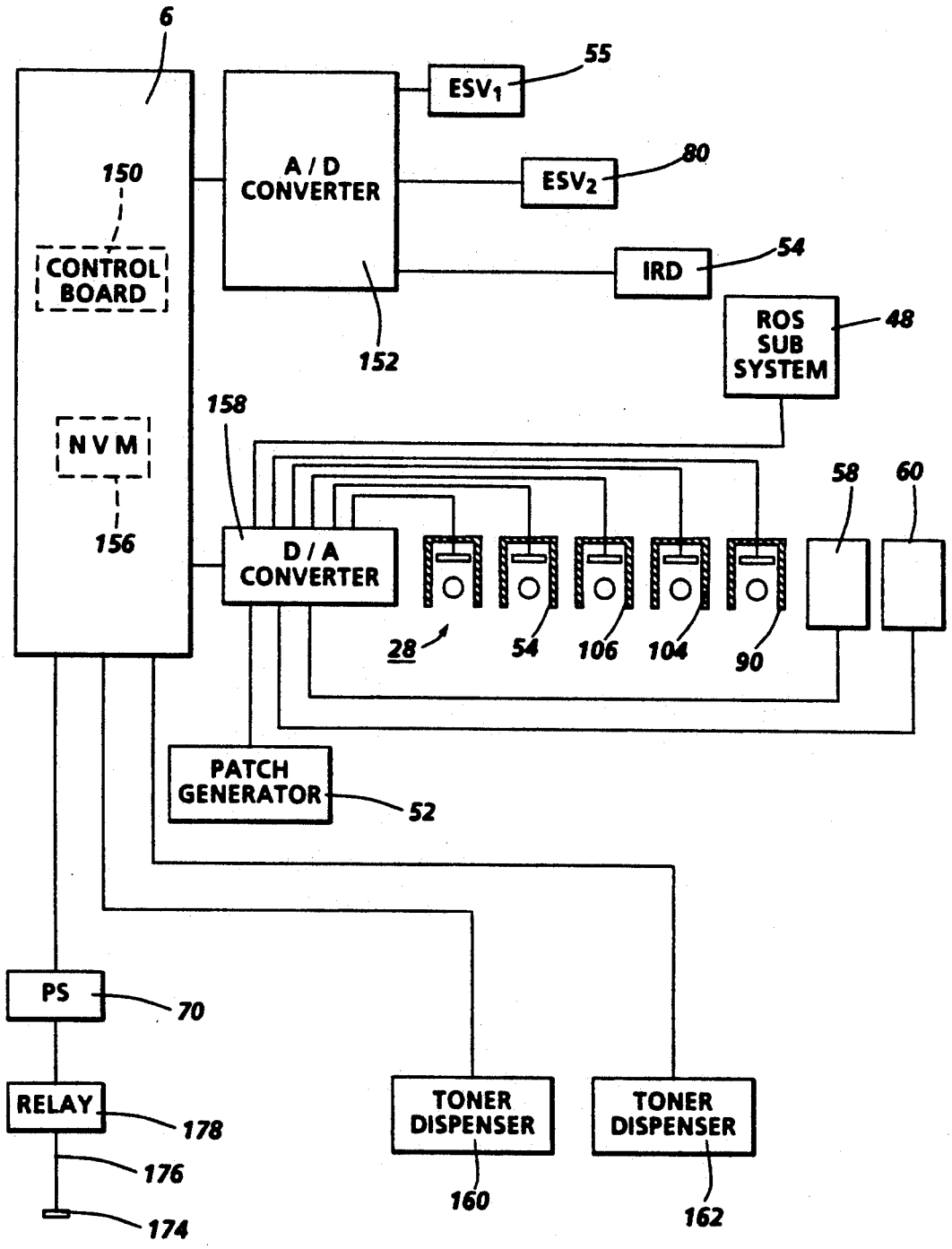
FIG. 4 is a block diagram illustrating the interaction among active components of the xerographic process module and the control devices utilized to control them.

FIG. 4 depicts the interconnection among active components of the xerographic process module 4 and the sensing or measuring devices utilized to control them. As illustrated therein, $ESV_1$, $ESV_2$ and IRD 54 are operatively connected to a control board 150 through an analog to digital (A/D) converter 152. $ESV_1$ and $ESV_2$ produce analog readings in the range of 0 to 10 volts which are converted by Analog to Digital (A/D) converter 152 to digital values in the range 0–255. Each bit corresponds to 0.040 volts (10/255) which is equivalent to photoreceptor voltages in the range 0–1500 where one bit equals 5.88 volts (1500/255).

The digital values corresponding to the analog measurements are processed in conjunction with a Non-Volatile Memory (NVM) 156 by firmware forming a part of the control board 150. The digital values arrived at are converted by a digital to analog (D/A) converter 158 for use in controlling the ROS 48, dicorotrons 28, 54, 90, 100 and 104 and the power supplies 70 and 71 for electrically biasing the developer structures 58 and 60. Toner dispensers 160 and 162 are controlled by the digital values. Target values for use in setting and adjusting the operation of the active machine components are stored in NVM.

Tri-level xerography requires fairly precise electrostatic control at both development stations. This is accomplished by using $ESV_1$ and $ESV_2$ to measure voltage states on the photoreceptor in test patch areas written in the interdocument zones between successive images. However, because the color developer material reduces the magnitude of the black development field in a somewhat variable manner, it is necessary to read the electrostatics associated with the black development following the color housing.

In such a system it is necessary that the ESVs are reasonably precise in their readings. Although the ESVs can be calibrated to a common source by a service representative, the ESV output is known to drift over time if charged toner particles are deposited within the unit. A single ESV cannot distinguish between charge on the photoreceptor and charge on a toner particle sitting inside the ESV housing.

In the dual ESV control system such as disclosed herein, $ESV_1$ is taken as the reference for calibration purposes. At each cycle up following a normal cycle down, the bias voltage output of one of the power supplies 70, 71 is routed to the photoreceptor ground plane connection 174 via conductor 176 and a high voltage relay 178 operatively connected to the electronic module 6. This output is applied for about 200 msec or just enough time for the $ESV_1$ and $ESV_2$ to read the voltage on the photoreceptor. $ESV_2$ is then adjusted to get the same reading as $ESV_1$. The adjustment of $ESV_2$ in the foregoing manner will keep the ESV readings precise with respect to each other. However, the development and cleaning fields associated with the development systems 58 and 60 will not be correct. This is because the bias voltages applied to the developer housings have not been adjusted according to the ESV readings. Thus, in addition to adjusting $ESV_2$ to compensate for the offset between it and $ESV_1$, the DC bias voltage supply outputs for both the color and the black developer housings are adjusted by the difference between the bias voltage output routed to the photoreceptor ground plane and the actual reading of the reference ESV, $ESV_1$.

As a result of the foregoing adjustments to $ESV_2$ and the developer housing biases, the combined voltage reading due to residual voltage on the photoreceptor and any combination of charged particles within the probe housing of the reference ESV ($ESV_1$) is arbitrarily set to set to zero. All other voltages are now established relative to the reference ESV. Therefore, all of the systems electrostatic values are properly set with respect to each other thereby maintaining proper development and cleaning fields over the life of the machine.

What is claimed is:

1. In a method of creating tri-level images on a charge retentive surface during operation of a tri-level imaging apparatus, the steps including:

moving said charge retentive surface past a plurality of process stations including a charging station where said charge retentive surface is uniformly charged, a plurality of developer structures for developing latent images and an illumination station for discharging said charge retentive surface;

applying electrical bias voltages to said developer structures;

applying a reference voltage to an uncharged charge retentive surface;

using a first sensor, sensing the voltage level of said charge retentive surface and generating a first signal representative of said voltage level;

using a second sensor, sensing the voltage level of said charge retentive surface and generating a second signal representative of said voltage level;

using one of said senors as a reference, adjusting a zero offset of the other of said sensors to achieve the same voltage reading as said one of said sensors and generating a signal representative of an amount of adjustment;

storing said signal representative of the amount of adjustment in memory; and.

adjusting the electrical bias voltages applied to said developer structures by an amount equal to a voltage difference between said reference voltage applied to said uncharged charge retentive surface and the voltage sensed by said reference sensor.

2. The method according to claim 1 wherein said step of applying a reference voltage to an uncharged charge retentive surface comprises applying a voltage equal to one of said electrical bias voltages.

3. The method according to claim 2 wherein said step of applying a reference voltage to an uncharged charge retentive surface comprises applying said reference voltage to a ground plane of said charge retentive surface.

4. The method according to claim 3 wherein said steps are initiated during a cycle up period following a normal cycle down of said imaging apparatus.

5. The method according to claim 4 wherein said steps are initiated during a cycle up period following each normal cycle down of said imaging apparatus.

6. The method according to claim 5 wherein said step of using one of said sensors comprises locating said sensor in a position which is less sensitive to contamination than a location occupied by said other of said sensors.

7. The method according to claim 6 wherein said signal representative of the amount of adjustment is utilized for adjusting subsequent sensor measurements between successive normal cycle down periods.

8. The method according to claim 7 wherein the steps of using first and second sensors comprises using electrostatic voltmeters.

9. Apparatus for creating tri-level images on a charge retentive surface during operation of a tri-level imaging apparatus, said apparatus comprising:

means for moving said charge retentive surface past a plurality of process stations including a charging station where said charge retentive surface is uniformly charged, a plurality of developer structures for developing latent images and an illumination station for discharging said charge retentive surface;

means for applying electrical bias voltages to said developer structures;

means for applying a reference voltage to a relatively uncharged portion of said charge retentive surface, Ser. No. 07/986,400 first sensor means for sensing a voltage level of said relatively uncharged portion of said charge retentive surface after said reference voltage is applied and generating a first signal representative of said voltage level;

second sensor means for sensing said voltage level of said relatively uncharged portion of said charge retentive surface and generating a second signal representative of said voltage level;

means for adjusting a zero offset of one of said sensors to achieve the same voltage reading as the other one of said sensors and generating a signal representative of an amount of adjustment;

means for storing said signal representative of said amount of adjustment stored in memory; and means for adjusting the electrical bias voltages applied to said developer structures by an amount equal to a voltage difference between said reference voltage applied to said uncharged charge retentive surface and the voltage sensed by said second sensor.

10. Apparatus according to claim 9 wherein said means for applying a reference voltage to an uncharged charge retentive surface comprises applying a voltage equal to one of said electrical bias voltages.

11. Apparatus according to claim 10 wherein said means for applying a reference voltage to an uncharged charge retentive surface comprises applying said reference voltage to a ground plane of said charge retentive surface.

12. Apparatus according to claim 11 wherein said means for sensing and adjusting are operable during a cycle up period following a normal cycle down of said imaging apparatus.

13. Apparatus according to claim 12 wherein said means for sensing and adjusting are operable during a cycle up period following each normal cycle down of said imaging apparatus.

14. Apparatus according to claim 13 wherein said means for generating a second signal is located in a position which is less sensitive to contamination than the location occupied by said other of said sensors.

15. Apparatus according to claim 14 wherein said signal representative of the amount of adjustment is utilized for adjusting subsequent sensor measurements between successive normal cycle down periods.

16. Apparatus according to claim 15 wherein said means for sensing comprises electrostatic voltmeters.

* * * * *